US007687979B2

(12) United States Patent
Huizar et al.

(10) Patent No.: US 7,687,979 B2
(45) Date of Patent: Mar. 30, 2010

(54) ELECTRIC LAMP/REFLECTOR UNIT EMPLOYING A CERAMIC INSERT

(75) Inventors: Jaime Huizar, Juarez (MX); Victor Jurado, Juarez (MX); Antonio Lopez, Juarez (MX)

(73) Assignee: Koninklijke Philips Electronics N.V., Eindhoven (NL)

( * ) Notice: Subject to any disclaimer, the term of this patent is extended or adjusted under 35 U.S.C. 154(b) by 873 days.

(21) Appl. No.: 10/536,229

(22) PCT Filed: Nov. 7, 2003

(86) PCT No.: PCT/IB03/05118

§ 371 (c)(1),
(2), (4) Date: May 24, 2005

(87) PCT Pub. No.: WO2004/049392

PCT Pub. Date: Jun. 10, 2004

(65) Prior Publication Data

US 2006/0163990 A1 Jul. 27, 2006

(51) Int. Cl.

| | |
|---|---|
| ***H01J 5/48*** | (2006.01) |
| ***H01J 7/24*** | (2006.01) |
| *H01J 61/40* | (2006.01) |
| *H01K 1/26* | (2006.01) |

(52) U.S. Cl. ..... 313/113; 313/318.01; 313/110; 313/112; 362/260; 219/121.5; 219/121.51

(58) Field of Classification Search ..... 313/513
See application file for complete search history.

(56) References Cited

U.S. PATENT DOCUMENTS

| | | | | |
|---|---|---|---|---|
| 4,839,553 | A * | 6/1989 | Mellor | 313/111 |
| 5,235,498 | A * | 8/1993 | Van Dulmen et al. | 362/549 |
| 5,281,889 | A | 1/1994 | Fields et al. | |
| 5,542,857 | A * | 8/1996 | Hume et al. | 439/337 |
| 5,646,473 | A * | 7/1997 | Eggink et al. | 313/113 |
| 6,111,359 | A * | 8/2000 | Work et al. | 315/56 |
| 6,168,293 | B1 * | 1/2001 | Lieszkovszky et al. | 362/297 |
| 6,252,338 | B1 * | 6/2001 | Bergman et al. | 313/113 |
| 6,382,816 | B1 | 5/2002 | Zhao et al. | |

(Continued)

FOREIGN PATENT DOCUMENTS

| | | |
|---|---|---|
| EP | 0397422 A2 | 11/1990 |

(Continued)

*Primary Examiner*—Sikha Roy
*Assistant Examiner*—Tracie Green

(57) ABSTRACT

The invention provides a new PAR 38 lamp/reflector unit comprising a halogen lamp of suitable power, i.e. 100 watts/120 volts, coated with infrared film to reflect infrared energy produced by the halogen lamp back to the filament, making it more efficient; that meets and preferably exceeds the minimum EPACT efficacy standards, that exhibits a median life of at least about 3000 hours, while giving light output greater than 90% from the original value at about 1750 hours. Unit comprises a double-ended electric lamp (10) arranged in a reflector body (1) in a manner that first end portion (21) is at least partly situated in the neck-shaped portion (5), cavity (13) is situated within reflecting portion (2), the electric light source (16) is predominantly situated on the optical axis (4), a ceramic insert (42), beneath mounting ring (40) through which the seal of first end portion (21) is passed, is effective to dissipate heat from first end portion (21) during operation of the lamp.

17 Claims, 2 Drawing Sheets

U.S. PATENT DOCUMENTS

| | | | | |
|---|---|---|---|---|
| 6,404,112 | B1 * | 6/2002 | Frings et al. | 313/113 |
| 6,528,931 | B1 * | 3/2003 | Umehara et al. | 313/318.01 |
| 6,600,256 | B2 * | 7/2003 | Van Lier et al. | 313/313 |
| 6,690,102 | B2 * | 2/2004 | Maassen et al. | 313/113 |
| 6,705,748 | B2 * | 3/2004 | Morris | 362/310 |
| 2005/0212437 | A1 * | 9/2005 | Ballenger et al. | 315/71 |

FOREIGN PATENT DOCUMENTS

| | | | |
|---|---|---|---|
| EP | 0397422 | A3 | 11/1990 |
| EP | 0397422 | B1 | 11/1994 |
| WO | WO9608035 | A1 | 3/1996 |
| WO | WO9715945 | A2 | 5/1997 |
| WO | WO0075957 | A1 | 12/2000 |

* cited by examiner

ELECTRIC LAMP/REFLECTOR UNIT EMPLOYING A CERAMIC INSERT

The invention relates to an electric lamp/reflector unit comprising a reflector body including a reflector portion having a concave reflecting surface with an optical axis and, integral therewith, a hollow neck-shaped portion about the optical axis, an electric lamp provided with a gastight light-transmitting lamp vessel which comprises: a quartz-glass wall which encloses a cavity of a predetermined, in general, spherical or elliptic shape with a geometric center, said quartz-glass wall being at least partly provided with an infrared-reflecting and visible light-transmitting coating, said cavity accommodating a substantially linear electric light source, a metal foil which is entirely embedded in the quartz-glass wall and connected to the electric light source, a first end portion and a second end portion which are arranged so as to be opposite to each other and which both comprise a seal, through which seals a respective current conductor, which is connected to the embedded metal foil, issues from the lamp vessel to the exterior.

The invention further relates to an electric lamp for use in an electric lamp/reflector unit.

Such electric lamp/reflector units are used as a source of white light for general and decorative lighting applications to show objects in their true colors.

Such a lamp is well known in the lighting industry and includes, for example, an electric lamp/reflector unit of the type mentioned in EP-A 0 397 422. In said document a description is given of a so-called double-ended halogen lamp provided with an infrared-reflecting interference filter, which lamp is arranged in a reflector body of the PAR 38 type, where the abbreviation PAR stands for Parabolic Aluminum Reflector, and the number "38" indicates a diameter of the reflector body at the location of the light emission window, the diameter being obtained by multiplying said number with an eighth of an inch, 1 inch being 25.4 mm, so that the diameter of the emission window of a PAR 38 reflector is 38×⅛ inch or approximately 121 mm.

As part of a worldwide movement towards more energy efficient lighting, in more recent years government legislation in the United States (commonly referred to as the national Energy Policy Act "EPACT") has mandated lamp efficacy values for many types of commonly used lamps including PAR lamps. Only products meeting these efficacy levels may be sold in the United States. These minimum efficacy values for PAR-38 incandescent lamps are for example, lamps of 51-66 W must achieve 11 lumens per Watt (LPW), lamps of 67-85 W must achieve 12.5 LPW, lamps of 86-115 W must achieve 14 LPW, and lamps in the range of 116-155 W must achieve 14.5 LPW. It is possible to design a lamp for a conventional PAR-38 lamp that will meet EPACT standards. However, designing such a lamp heretofore has resulted in a greatly reduced lamp life. This is attributed to the fact that while the IR-coated burner has a higher brightness and a higher luminous efficacy, the seal of the lamp vessel assumes a comparatively high temperature during operation which high temperature results in shortened lamp life. Another cause of the short life of halogen lamps is molybdenum corrosion. For these and other reasons, as the press temperature increases, the possibility of the lamp failing early increases as well.

U.S. Pat. No. 5,646,473, titled "ELECTRIC REFLECTOR LAMP", issued Jul. 8, 1997 and assigned to the same assignee as in the present application, relates to an electric reflector lamp in which the lamp vessel contains a light source that may be, for example, an incandescent body in a gas comprising halogen and may be covered with an IR-reflecting interference filter. The lamp also comprises a ceramic body which surrounds the seal to lower the temperature during operation. Such lamps are disclosed to be of relatively low power, for example, 75 W for a lamp without an IR-reflecting interference filter, and 68 W for a lamp without an IR-reflecting interference filter, when operated at mains voltage. The lamp life and efficacy of such lamps are not disclosed.

U.S. Pat. No. 5,281,889 issued Jan. 25, 1994 and assigned to a predecessor company of the assignee in the present application, discloses a reflector lamp of the PAR 16 dimension having a bipartite neck. The mounting member, a plate with resilient tags which hold the seal with clamping force, is enclosed between the two parts of the neck. Such a lamp comprises a ceramic extender assembled on and glued to the reflector.

There is a need in the art for a PAR 38 lamp and lamp reflector unit that comprises a halogen lamp of suitable power greater than 68 W, for example 100 Watts coated with an infrared film to reflect the infrared energy produced by the halogen lamp back to the filament, making it more efficient; and/or that meets and preferably exceeds the minimum EPACT efficacy standards; and/or that exhibits a median life of at least about 3000 hours, while giving light output greater than 90% from the original value at about 1750 hours; and/or that exhibits all of the foregoing characteristics or combinations thereof.

An object of the invention is to provide a new PAR 38 lamp and lamp reflector unit that comprises a halogen lamp of suitable power greater than 68 W, for example 100 Watts coated with an infrared film to reflect the infrared energy produced by the halogen lamp back to the filament, making it more efficient; and/or that meets and preferably exceeds the minimum EPACT efficacy standards; and/or that exhibits a median life of at least about 3000 hours, while giving light output greater than 90% from the original value at about 1750 hours; and/or that exhibits all of the foregoing characteristics or combinations thereof.

These and other objects of the invention will be apparent from a description of the invention which follows.

The objects of the invention may be accomplished through the provision of a PAR-38 lamp and lamp/reflector unit having the characteristics described above which comprises a reflector body (1) including a reflector portion (2) having a concave reflecting surface (3) with an optical axis (4) and, integral therewith, a hollow neck-shaped portion (5) about the optical axis (4), an electric lamp (10) comprising:

(a) a light-transmitting lamp vessel (11) said lamp vessel comprising a quartz-glass wall (12) which encloses a cavity (13) of a predetermined, in general, spherical or elliptical shape with a geometric center (14), said wall (12) being at least partly provided with an infrared-reflecting and visible light-transmitting coating (15), and said cavity (13) accommodating a substantially linear electric light source 16 ), (b) a metal foil (17, 18) which is entirely embedded in the wall (12) and connected to the electric light source (16), (c) a first end portion (21) and a second end portion (22) which are arranged so as to be opposite to each other and which both comprise a seal, (d) a respective current conductor (23; 24) connected to the embedded metal foil (17; 18 ) which issues from the lamp vessel (11) to the exterior, and is connected to metal foil through the seals, (e) a metal positioning member (40) in the neck which holds the lamp vessel and through which the lamp seal is passed, (f) and a ceramic insert (42) beneath the mounting ring and through which the seal of the first end portion is passed, wherein, the electric lamp (10) is arranged in the reflector body (1) in such a manner that the first end portion (21) is at least partly situated in the neck-shaped portion (5), the cavity (13) is situated within the reflecting portion (2), the electric light source (16) is predominantly situated on the optical axis (4), and the ceramic insert is effective to dissipate heat from the first end portion (21) during operation of the lamp.

U.S. Pat. No. 6,404,112B1, issued Jun. 11, 2002, titled "Electric Lamp/Reflector Unit" and assigned to the same assignee as in this application, relates to a way to adapt the dimensions of a double-ended halogen lamp and a reflector body so as to attain a satisfactory temperature balance. These principles may be employed in this invention as well and the disclosure of said patent is incorporated herein by reference. When embodied in the present invention, as described in said patent, the connection point (28) where the first end portion current conductor (23) is connected to the metal foil (17) of the first end portion (21) may be a distance $d_c^I$ from the geometric center (14), the first end portion (21) will have a length $l_{ep}^I$ measured from the geometric center (14), the connection point (27) where the second end portion current conductor (24) is connected to the metal foil (18) of the second end portion (22) will be a distance $d_c^{II}$ from the geometric center (14), the second end portion (22) will have a length $l_{ep}^{II}$ measured from the geometric center (14), and the ratios of the distances $d_c^I$; $d_c^{II}$ to the respective lengths $l_{ep}^I$; $l_{ep}^{II}$ is $d_c^I/l_{ep}^I>0.75$ and $d_c^{II}$; $l_{ep}^{II}>0.75$.

In accordance with the invention, an improvement in PAR-38 lamps, it has been found that the EPACT standards, the lamp efficiency and a long lamp life may be attained while lowering the press temperature to a safe operating temperature by practicing the invention parameters above described.

In preferred embodiments of the invention, one of the end portions of the electric lamp is arranged at least partly in the neck portion of the reflector body, it is achieved, viewed along the optical axis, to reduce the relative height of the electric lamp, if desired, with respect to the reflector body, which has a favorable influence on the ratio of the dimensions of the double-ended electric lamp with respect to the dimension of the reflector body of the known electric lamp/reflector unit. In the known electric lamp/reflector unit, a double-ended halogen lamp is bodily arranged in the reflector portion of the reflector body by means of so-called mounting legs. By securing, in accordance with the invention, the first end portion of the electric lamp in the neck portion of the reflector body, a sturdy and reliable connection of the electric lamp with the reflector body is achieved. In addition, the positioning of the electric light source on the optical axis of the reflector portion is improved thereby, the electric light source preferably being positioned such that the geometric center of the electric lamp is situated in the focus of the concave reflecting surface. The improved positionability results in a higher light output and a better light distribution of the electric lamp/reflector unit.

The inventors have recognized that in the known electric lamp/reflector unit, the so-called pinch temperature of the electric lamp increases during operation which adversely affects, in particular, the service life of the electric lamp. The temperature of the pinch of a lamp is measured at the location of the connection point (generally formed by a welded joint) of the (external) current conductor and the metal foil embedded in the wall of the electric lamp. In general, a high pinch temperature enhances corrosion of the metal foil and/or the external current conductor. Corrosion leads to failure of the lamp as a result of the current supply being interrupted. Other causes of failure include, for example, leakage of the lamp vessel or non-passive failure of the lamp. In the electric lamp in accordance with the invention, a ceramic insert inside of a electric lamp/reflector unit is effective to lower the pinch temperature and avoid thermal shock of the halogen burner. The halogen burner is placed through the ceramic insert and fit into the reflector wherein the ceramic insert acts as a heat sink taking the heat off the press. The ceramic insert fits tight onto the inside part of the glass reflector and has an orifice in the center which the halogen burner passes through. This allows the heat to be conducted off the burner and out of the lamp more effectively and a reduction of the pinch temperature is obtained.

The safety of the electric lamp/reflector unit is enhanced if the emission window of the reflector body is closed by means of a lens (31). In this manner, it can be precluded that inflammable objects come into contact with hot parts of the lamp. In addition, such a lens can limit the risks as a result of a non-passive failure of the lamp vessel by containing within the outer envelope the energy released by the non-passive failure. The lens may be fixed to the reflector body by means of an adhesive 43, for example silicone paste. Alternatively, the lens can be secured mechanically, using, for example, a metal ring which is rolled over the reflector body. A clamping ring or a number of clamps may alternatively be used. The lens may be flat or curved.

In a favorable modification, the reflecting portion has a substantially cylindrical end portion near the lens. By virtue thereof, the volume within the reflecting portion can be larger so as to obtain a lower overall temperature, if so desired, without the increase in volume leading to an increase in diameter of the unit. It is alternatively possible to provide the reflector body at the outside with a profiled, for example rippled, surface. As a result, the surface area is increased, enabling a greater heat emission.

The electric lamp may be an incandescent body, for example in a halogen-containing inert gas, or an electrode-pair in an ionizable gas. Particularly if the cavity of the lamp vessel is in the shape of an ellipse provided with an infrared-reflecting and visible light-transmitting coating, and if a spiral-shaped linear incandescent body is arranged in the cavity, the heat in the form of infrared light generated by the incandescent body is very effectively reflected back to the incandescent body, as a result of which the current demanded from the power source is reduced, so the lamp becomes more efficient.

The ceraminc insert may be formed of materials known in the art, for example, it may be made of steatite, aluminum oxide, aluminum nitride, or the like. Particularly preferred for use herein is a material available commercially as L3 Steatite which comprises $SiO_2$—MgO—BaO.

A particularly favorable embodiment of the electric lamp/reflector unit in accordance with the invention is characterized in that an internal current conductor which connects the electric light source with the metal foil is bent such that the electric light source is substantially situated on the optical axis. The better the electric light source is centered with respect to the spherical or elliptic shape of the cavity, the more effective the action of the infrared-reflecting coating and the higher the efficiency of the electric lamp is. In addition, the better the electric light source is centered with respect to the geometric center, which is preferably situated on the optical axis of the reflector body, the better the light distribution is as a result of the reflection from the concave reflecting surface of the reflector body.

In order to further reduce the temperature of the end portions, said end portions may be sandblasted during the manufacture of the electric lamp. This has the advantage that the end portions are not covered with an infrared-reflecting coating, which leads to a reduction of the temperature of the end portions and hence of the pinch temperature. An additional advantage of sandblasting resides in that the surface of the end portions is roughened, so that a larger heat-radiating surface is obtained and hence overall internal light reflection in the end portions as a result of the coating is reduced.

In a preferred embodiment of the electric lamp/reflector unit in accordance with the invention, the metal foil and the first and the second current conductor may be at least partly provided with a protective coating at the location of the connection point. This protective coating reduces the risk of corrosion of the metal foil and the current conductor at the location of the connection point. As a result of said corrosion protection, an acceptable service life of the electric lamp in the electric lamp/reflector unit may also be extended while the risk of explosion of the lamp is negligible. Preferably, the protective coating contains chromium. It has been found that chromium can be effectively used as a protective coating on electric conductors of molybdenum and tungsten in quartz glass, and forms low-melting products with these materials. A chromium protective layer having a layer thickness in the range from 0.5 to 2 .mu.m is particularly favorable. The layer thickness of the coating is a parameter which, among other things, determines the degree of corrosion protection.

In a particularly favorable embodiment, the current conductor is led from the second end portion via an electroconductive connection to the neck-shaped portion of the reflector body. Preferably, the connection is at least partly made from nickel. Nickel is a stable material having a good coefficient of heat conduction and it can also be used as a contact member of the electric lamp/reflector unit. A material which can be alternatively used for the manufacture of said connection is stainless steel.

These and other aspects of the invention will be apparent from and elucidated with reference to the embodiments described hereinafter.

The invention will be better understood with reference to the details of specific embodiments that follow.

The Figures are purely diagrammatic and not drawn to scale. Particularly for clarity some dimensions are exaggerated strongly. In the Figures, like reference numerals refer to like parts whenever possible.

Figure 1:
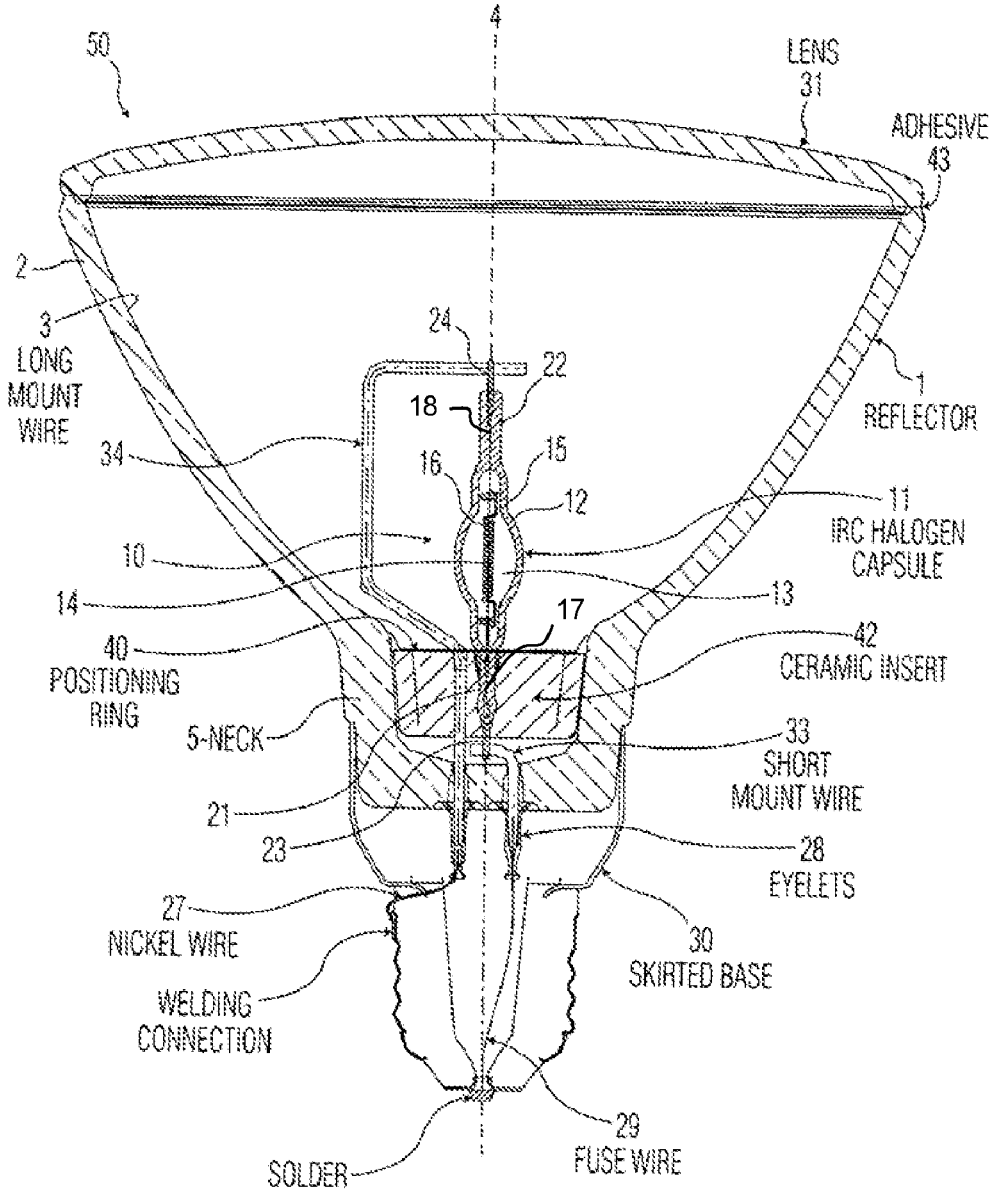
FIG. 1 is a cross-sectional view of an electric lamp/reflector unit in accordance with the invention.
Figure 2:
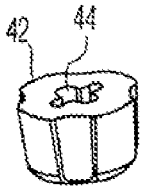
FIG. 2 is a view of a ceramic insert of the invention.

FIG. 1 shows an electric lamp/reflector unit in accordance with the invention in cross-section. As illustrated, the electric lamp/reflector unit 50 comprises a shaped reflector body 1 having a reflector portion 2 with a concave reflecting surface 3 and an optical axis 4. A hollow, neck-shaped portion 5 situated around the optical axis 4 is integral with the reflector portion 2. In the example shown in FIG. 1, the emission window of the reflector body 1 is closed by means of a curved lens 31. In an alternative embodiment, said lens 31 is flat. The embodiment of the electric lamp/reflector unit shown in FIG. 1 is the reflector body 1 of the PAR 38 type.

The electric lamp/reflector unit further comprises an electric lamp 10 including a gastight light-transmitting lamp vessel 11 having a quartz glass wall 12 enclosing a cavity 13 of a predetermined, generally, spherical or elliptic shape with a geometric center 14. In the example shown in FIG. 1, the shape of the cavity 13 is substantially elliptical. The cavity 13 of the lamp vessel 11 accommodates a substantially linear electric light source 16, for example an incandescent body in the form of a spirally wound tungsten wire. At the location where the wall 12 of the lamp vessel 11 is elliptical in shape, the wall 12 of the lamp vessel 11 is provided with an infrared-reflecting and visible light-transmitting coating 15. The infrared radiation generated by the incandescent body is reflected back to the incandescent body by this coating 15, causing the efficiency of the electric lamp 10 to be increased substantially. The visible light is passed by the coating 15.

The infrared-reflecting and visible light-transmitting coatings 15 are known per se. Such (>40 layers), the thicknesses of the individual coatings generally comprise a multilayer interference filter optical layers being calculated by means of computer programs known to those skilled in the art. Such optical interference films are generally applied by means of coating techniques which are known per se, such as vapor deposition, dip coating, (reactive) sputtering and chemical vapor deposition.

Figure 3:
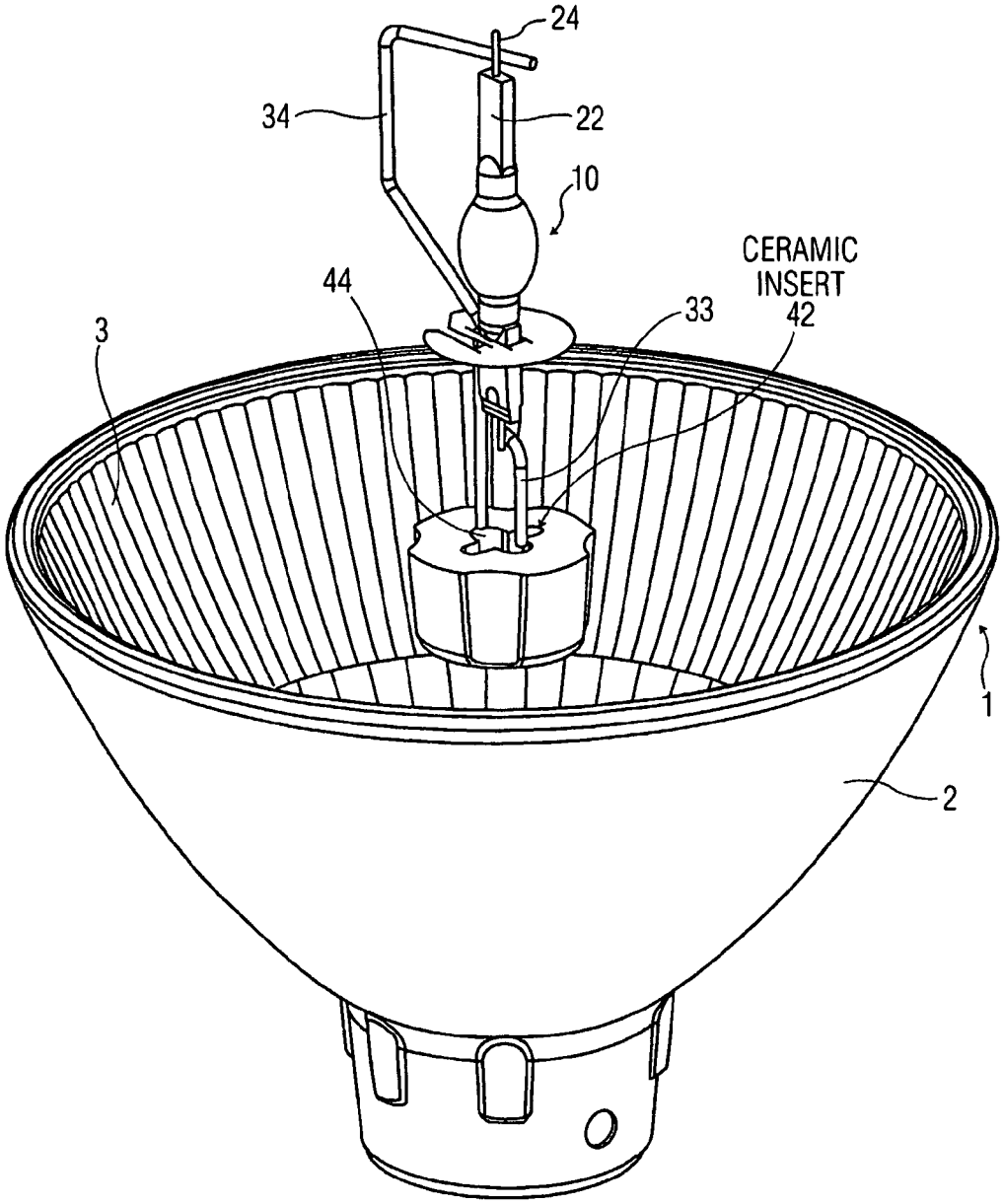
FIG. 3 is a perspective of the halogen burner with connectors, metal positioning ring, ceramic insert, and reflector body of the invention (unassembled).

In FIG. 1, the geometric center 14 of the electric lamp/reflector unit is situated at the intersection of the optical axis 4 and a further axis 4'; 4" at right angles to the optical axis 4, in the center of the lamp vessel 11. In the wall 12 of the electric lamp 10, metal foils (17, 18) may be embedded on both sides. These metal foils are connected to the electric light source 16. The electric lamp 10 further comprises a first end portion 21 and a second end portion 22 which are both provided with a seal. The second end portion 22 is arranged so as to be opposite to the first end portion 21. An electric lamp 10 comprising a combination of two end portions 21; 22 between which there is a cavity is commonly referred to as a double-ended electric lamp, in the example shown in FIGS. 1 and 3, a so-called double-ended halogen lamp. Through the end portions 21; 22, current conductors 23; 24 which are connected to the embedded metal foil issue from the lamp vessel 11 to the exterior.

The electric lamp 10 is arranged in the reflector body 1, the first end portion 21 being situated at least partly in the neck-shaped portion 5, the cavity 13 being situated within the reflecting portion 2, and the electric light source 16 being situated substantially on the optical axis 4.

FIG. 1 further shows that the current conductor 24 projects from the second end portion 22 and is guided via an electroconductive connection 34, to the neck-shaped portion 5 of the reflector body 1. A particularly favorable connection 34 is made from nickel. The current conductor 23 is correspondingly connected to an electroconductive connection 33. These parts are passed through the metal positioning ring 40 and through the ceramic insert 42 with the connectors 34 and 33 passing through holes 44 of the ceramic insert. Both connections 33; 34 issue from the ceramic insert to the exterior to eyelets 28 which complete the connection to fuse wire 29 and nickel wire 27 which are welded, soldered or otherwise attached to the skirted base 30.

Two types of 100 watt/120 volt double-ended halogen lamp vessels were evaluated for the manufacturing of a PAR 38 electric lamp/reflector unit of this invention. Lot A lamp vessels were manufactured with filling gas with 5.5 Bars of pressure, and Lot B were manufactured with filling gas with 6.5 Bars of pressure. A sample of 20 capsules of each lot was assembled into PAR 38 lamps and they were lifetime tested. The results are reported in Table 1.

TABLE #1

Lifetime lamps manufactured without ceramic insert.

| TEST NUMBER | ACTUAL LIFETIME | LAMP SAMPLE | NUMBER OF FAILURES | FAILURE RATE | FAILURE MODE |
|---|---|---|---|---|---|
| 2ET31 | 1705 hours | 20 | 20 | 5% at 837 hours. | 1× split pinch. |
| Lamps made without | | | | 35% at 1059 hours. | 3× Split pinch, blackening, broken coil. |
| ceramic insert | | | | | 3× Split pinch, broken coil. |
| Capsules from lot A. | | | | 5% at 1195 hours. | 2× Split pinch, broken coil. |
| | | | | | 1× Split pinch, broken coil, blackening |
| | | | | 65% at 1206 hours. | 1× Split pinch, 1× split pinch, blackening. |
| | | | | | 1× Split pinch. |
| | | | | 90% at 1463 hours | 3× Split pinch, blackening, broken coil. |
| | | | | | 1× Split pinch, broken coil. |
| | | | | 95% at 1569 hours | 1× Split pinch, blackening, broken coil. |
| | | | | 100% at 1705 hours | 1× Split pinch, broken coil. |
| 2ET25 | 1596 hours | 20 | 20 | 30% at 671 hours. | 2× Split pinch, broken coil. |
| Lamps made without | | | | | 4× Split pinch, broken coil, blackening. |
| ceramic insert | | | | 55% at 839 hours. | 1× Split pinch, broken coil. |
| Capsules from lot B. | | | | | 4× Split pinch, broken coil, blackening. |
| | | | | 60% at 999 hours. | 1× Split pinch, broken coil, blackening. |
| | | | | 80% at 1181 hours. | 4× Split pinch, broken coil. |
| | | | | 90% at 1343 hours. | 1× Split pinch |
| | | | | | 1× Split pinch, blackening. |
| | | | | 95% at 1443 hours. | 1× Split pinch, blackening, broken coil. |
| | | | | 100% at 1596 hours. | 1× Split pinch blackening, broken coil. |

In this test the results in lifetime were very poor having a median life around 900 to 1300 hours. In addition, it was also observed that the common failure mode was split pinch on the capsules. Moreover, before the pinch of the lamp vessel or capsule split, the high working temperature caused the coating applied to the body of the capsule to degrade. This degradation manifested itself by turning the capsule black, thus reducing the light output.

A thermocouple was attached in the pinch area of the burner and it was assembled into a lamp. This lamp was lighted in fixtures during one hour and the temperature was registered. This procedure was performed on five lamps to choose the maximum temperature of the five lamps.

Because of the high temperature found in this test, five lamps were assembled with a ceramic insert to investigate if this ceramic could reduce the pinch temperature. The results are reported in Table 2.

TABLE #2

Capsule pinch temperature.

| CAPSULE DESCRIPTION | PAR 38 LAMP Ceramic | PAR 38 LAMP No ceramic | TEMPERATURE DIFFERENCE |
|---|---|---|---|
| 100 W/120 V | 359° C. | 445° C. | 86° C. |
| 100 W/130 V | 342° C. | 407° C. | 65° C. |
| *92 W/120 V | 318° C. | 378° C. | 60° C. |

Note:
*Lamps with 100 watts/130 volts capsule tested @ 120 volts.

From these results it was observed that the ceramic insert reduced the capsule working temperature.

Another sample of 20 capsules of each lot (A and B) was assembled into PAR 38 lamps for lifetime evaluation. This time the ceramic insert was added to the lamp assembly. The results are reported in Table 3.

TABLE #3

Lifetime performed to lamps manufactured with ceramic insert.

| TEST NUMBER | ACTUAL LIFETIME | LAMP SAMPLE | NUMBER OF FAILURES | FAILURE RATE | FAILURE MODE |
|---|---|---|---|---|---|
| 2ET42 Lamps made with ceramic insert Capsules from lot A. | >1600 hours | 20 | 0 | 0 | No failures have occurred yet and the test is on going. |
| 2ET35 Lamps made with ceramic insert Capsules from lot B. | >2700 hours | 20 | 0 | 0 | No failures have occurred yet and the test is on going. |

The above lifetime tests were extended. No failures have occurred after 3000 hours and the tests are still ongoing.

The lamp vessel 11 of the double-ended halogen lamps in accordance with the invention preferably has an elliptical cavity 13. The outer surface of the cavity 13 is provided with an infrared-reflecting and visible light-transmitting coating 14. The coating 14 preferably comprises a 47-layer $Nb_2O_5/SiO_2$ infrared-reflecting interference filter which is provided by means of reactive sputtering.

It will be obvious that, within the scope of the invention, many variations are possible to those skilled in the art. For example, the invention is not limited to an electric lamp/reflector unit comprising an electric lamp including an incandescent body; the electric lamp may alternatively comprise an electrode pair in an ionisable gas. In addition, the infrared-reflecting and visible light-transmitting coating provided on the electric lamp may be omitted.

The scope of protection of the invention is not limited to the above-described examples. The invention is embodied in each novel characteristic and each combination of characteristics. Reference numerals in the claims do not limit the scope of protection thereof. The use of the term "comprising" does not exclude the presence of elements other than those mentioned in the claims. The use of the word "a" or "an" in front of an element does not exclude the presence of a plurality of such elements.

The invention claim is:

1. An electric lamp/reflector unit, capable of operating at a power greater than 68 W, comprising:

a reflector body including a reflector portion having a concave reflecting surface with an optical axis and, integral therewith, a hollow neck-shaped portion about the optical axis, an electric lamp comprising:

(a) a light-transmitting lamp vessel, said lamp vessel comprising a quartz-glass wall which encloses a cavity of a predetermined, in general, spherical or elliptical shape with a geometric center, said wall being at least partly provided with an infrared-reflecting and visible light-transmitting coating, and said cavity accommodating a substantially linear electric light source, (b) first and second metal foils which are entirely embedded in the wall and connected to the electric light source, (c) a first end portion and a second end portion which are arranged so as to be opposite to each other and which both comprise a seal, wherein said second end portion is above the neck-shaped portion and is within the reflector portion, (d) first and second current conductors respectively connected to the embedded first and second metal foils through respective seals of the first and second end portions, wherein said current conductors issues from the lamp vessel to the exterior, (e) an electroconductive connector that is coupled to the second current conductor issuing from the second end portion, (f) a metal positioning member in the neck-shaped portion which holds the lamp vessel and through which the seal of the first end portion is passed, and (g) a ceramic insert beneath the metal positioning member and through which the seal of the first end portion and the electroconductive connector are passed, wherein the ceramic insert is dimensioned such that a lateral thickness of the ceramic insert between the electroconductive connector and a closest outer wall of the ceramic insert is greater than a distance between the electroconductive connecter and a portion of the optical axis on which the first end portion is situated, and the electric lamp is arranged in the reflector body in such a manner that the first end portion is at least partly situated in the neck-shaped portion, the cavity is situated within the reflecting portion, the electric light source is predominantly situated on the optical axis, and the ceramic insert is effective to dissipate heat from the first end portion during operation of the lamp.

2. An electric lamp/reflector unit as claimed in claim 1, wherein the electric lamp meets at least the minimum EPACT efficacy standards.

3. An electric lamp/reflector unit as claimed in claim 1, wherein the connection point where the first current conductor is connected to the first metal foil in the first end portion is a distance $d_c^I$ from the geometric center, the first end portion has a length $l_{ep}^I$ measured from the geometric center, the connection point where the second current conductor is connected to the second metal foil in the second end portion is a distance $d_c^{II}$ from the geometric center, the second end portion has a length $l_{ep}^{II}$ measured from the geometric center, and the ratios of the distances $d_c^I$; $d_c^{II}$ to the respective lengths $l_{ep}^I$; $l_{ep}^{II}$ is $d_c^I/l_{ep}^I>0.75$ and $d_c^{II}/l_{ep}^{II}>0.75$.

4. An electric lamp/reflector unit as claimed in claim 1, wherein the ceramic insert fits tight onto the inside part of the glass reflector and has an orifice in the center which the lamp vessel passes through.

5. An electric lamp/reflector unit as claimed in claim 1, wherein the reflector body is closed by means of a lens.

6. An electric lamp/reflector unit as claimed in claim 5, wherein the cavity of the lamp vessel is in the shape of an ellipse and is provided with an infrared-reflecting and visible light-transmitting coating.

7. An electric lamp/reflector unit as claimed in claim 6, wherein a spiral-shaped linear incandescent body is arranged in the cavity and the heat in the form of infrared light generated by the incandescent body is reflected back to the incandescent body.

8. An electric lamp/reflector unit as claimed in claim 1, wherein the electroconductive connector is a first electroconductive connector, the second current conductor is guided via the first electroconductive connector to the neck-shaped portion of the reflector body and the first current conductor is correspondingly connected to a second electroconductive connector.

9. An electric lamp/reflector unit as claimed in claim 8, wherein the electroconductive connectors are at least partly made from a nickel or stainless steel member.

10. An electric lamp/reflector unit as claimed in claim 1, wherein the coating comprises a multilayer interference filter.

11. An electric lamp/reflector unit as claimed in claim 10, wherein said coating is a layered $Nb_2O_5/SiO_2$ infrared-reflecting interference filter.

12. An electric lamp/reflector unit as claimed in claim 8, wherein: the lamp vessel with the connectors pass through the metal positioning member and through the ceramic insert, with the connectors passing through holes of the ceramic inset

13. An electric lamp/reflector unit as claimed in claim 12, wherein said connectors issue from the ceramic insert to the exterior to eyelets.

14. An electric lamp/reflector unit as claimed in claim 13, wherein said eyelets complete a connection to fuse wire and nickel wire which are attached to a skirted base.

15. An electric lamp/reflector unit as claimed in claim 1, wherein the electric lamp/reflector unit is a PAR 38 lamp/reflector unit, wherein said electric lamp is a halogen lamp of power greater than 68 W coated with an infrared film to reflect the infrared energy produced by the halogen lamp back to a filament to improve efficiency, wherein said PAR 38 lamp/reflector unit meets minimum EPACT efficacy standards and exhibits a median life of at least about 3000 hours.

16. An electric lamp/reflector unit, capable of operating at a power greater than 68 W, comprising:

a reflector body including a reflector portion having a concave reflecting surface with an optical axis and, integral therewith, a hollow neck-shaped portion about the optical axis, an electric lamp comprising:

(a) a light-transmitting lamp vessel, said lamp vessel comprising a quartz-glass wall which encloses a cavity of a predetermined, in general, spherical or elliptical shape with a geometric center, said wall being at least partly provided with an infrared-reflecting and visible light-transmitting coating, and said cavity accommodating a substantially linear electric light source, (b) a first and second metal foils which are entirely embedded in the wall and connected to the electric light source, (c) a first end portion and a second end portion which are arranged so as to be opposite to each other and which both comprise a seal, wherein said second end portion is above the neck-shaped portion and is within the reflector portion, (d) first and second current conductors respectively connected to the embedded first and second metal foils through respective seals of the first and second end portions, wherein said current conductors issue from the lamp vessel to the exterior, (e) a first electroconductive connector that is coupled to the second current conductor issuing from the second end portion, (f) a metal positioning member in the neck-shaped portion which holds the lamp vessel and through which the seal of the first end portion is passed, (g) a ceramic insert beneath the metal positioning member and through which the seal of the first end portion and the first electroconductive connector are passed, wherein, the ceramic insert is dimensioned such that a lateral thickness of the ceramic insert between the first electroconductive connector and a closest outer wall of the ceramic insert is greater than a distance between the first electroconductive connecter and a portion of the optical axis on which the first end portion is situated, the electric lamp is arranged in the reflector body in such a manner that the first end portion is at least partly situated in the neck-shaped portion, the cavity is situated within the reflecting portion, the electric light source is predominantly situated on the optical axis, and the ceramic insert is effective to dissipate heat from the first end portion during operation of the lamp, and the second current conductor is guided via the first electroconductive connector to the neck-shaped portion of the reflector body and the first current conductor is correspondingly connected to a second electroconductive connector, the lamp vessel with the connectors pass through the metal positioning member and through the ceramic insert, with the connectors passing through holes of the ceramic insert, said connectors issue from the ceramic insert to the exterior to eyelets, wherein said eyelets complete a connection to a fuse wire and nickel wire which are attached to a skirted base.

17. An electric lamp/reflector unit as claimed in claim 1, wherein the electric lamp exhibits a median life of at least about 3000 hours.

* * * * *